US006445359B1

(12) United States Patent
Ho

(10) Patent No.: US 6,445,359 B1
(45) Date of Patent: Sep. 3, 2002

(54) LOW NOISE BLOCK DOWN CONVERTER ADAPTER WITH BUILT-IN MULTI-SWITCH FOR A SATELLITE DISH ANTENNA

(75) Inventor: Kesse Ho, Westminster, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/676,065

(22) Filed: Sep. 29, 2000

(51) Int. Cl.[7] ..... H01Q 19/12
(52) U.S. Cl. ..... 343/840; 343/756
(58) Field of Search ..... 343/840, 906, 343/781 R, 756; H01Q 19/12

(56) References Cited

U.S. PATENT DOCUMENTS 5,212,553 A * 5/1993 Maruoka ..... 358/188
5,448,254 A * 9/1995 Schneeman et al. .... 343/781 R
5,448,255 A 9/1995 Hulett et al. ..... 343/840
5,483,663 A 1/1996 Tawil ..... 455/3.2
5,600,336 A * 2/1997 Kubo et al. ..... 343/756
5,825,333 A * 10/1998 Kudoh et al. ..... 343/781 R
5,959,592 A * 9/1999 Petruzzelli ..... 343/840
5,999,138 A 12/1999 Ponce de Leon ..... 343/745
6,166,704 A 12/2000 Jan et al. ..... 343/840
6,222,495 B1 4/2001 Cook et al. ..... 343/840

* cited by examiner

*Primary Examiner*—Hoanganh Le
(74) *Attorney, Agent, or Firm*—John A. Crook; Michael W. Sales

(57) ABSTRACT

A low noise block down converter adapter for an antenna includes a Y-shaped housing that is mated to one end of a support bracket, as well as a plurality of low noise block down converters with feed (LNBFs). The adapter incorporates a plurality of ports for connecting to the LNBFs, a plurality of outputs to a plurality of integrated receiver-decoders (IRDs), and a multi-switch for selecting among the connectors to connect a selected one of the plurality of LNBFs to a selected one of the outputs.

17 Claims, 5 Drawing Sheets

LOW NOISE BLOCK DOWN CONVERTER ADAPTER WITH BUILT-IN MULTI-SWITCH FOR A SATELLITE DISH ANTENNA

CROSS-REFERENCE TO RELATED APPLICATION

This application is related to co-pending and commonly-assigned application Ser. No. 09/675,526, filed on same date herewith, by Dipak M. Shah, and entitled "AGGREGATED DISTRIBUTION OF MULTIPLE SATELLITE TRANSPONDER SIGNALS FROM A SATELLITE DISH ANTENNA," which application is incorporated by reference herein.

BACKGROUND OF THE INVENTION

1. Field of the Invention

The present invention relates generally to a satellite receiver antenna, and in particular, to a low noise block down converter adapter with built-in multi-switch for a satellite dish antenna.

2. Description of the Related Art

In a multiple-satellite application, such as satellite broadcast television, an integrated receiver-decoder (IRD) must work through a multi-switch (Multi-SW) to reach a given low noise block down converter with feed (LNBF). The present state of art is to use a discrete multi-switch mounted either at the back of the antenna, at the point of entry to the home, or inside the home. However, many cables must be used to connect the LNBFs to the multi-switch, resulting in errors of connection, longer installation time, and higher costs.

In addition to using the discrete multi-switch described above, there have been attempts by the industry to try to implement the multi-switch function into the LNBFs. The disadvantages of doing this is that the cost of production of an integrated LNBF/multi-switch is much more than the discrete parts. Moreover, the cost of repair is also much higher, since if one LNBF is bad, the entire assembly must be replaced.

Thus, there is a need in the art for an improved multi-switch for use with LNBFs in satellite antenna applications.

SUMMARY OF THE INVENTION

The present invention describes an improved low noise block down converter adapter for a satellite dish antenna. The adapter includes a Y-shaped housing that is mated to one end of a support bracket, as well as a plurality of low noise block down converters with feed (LNBFs). The adapter incorporates a plurality of ports for connecting to the LNBFs, a plurality of outputs to a plurality of integrated receiver-decoders (IRDs), and a multi-switch for selecting among the connectors to connect a selected one of the plurality of LNBFs to a selected one of the outputs.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description, reference is made to the accompanying drawings which form a part hereof, and which show, by way of illustration, several embodiments of the present invention. It is understood that other embodiments may be utilized and structural changes may be made without departing from the scope of the present invention.

Figure 1:
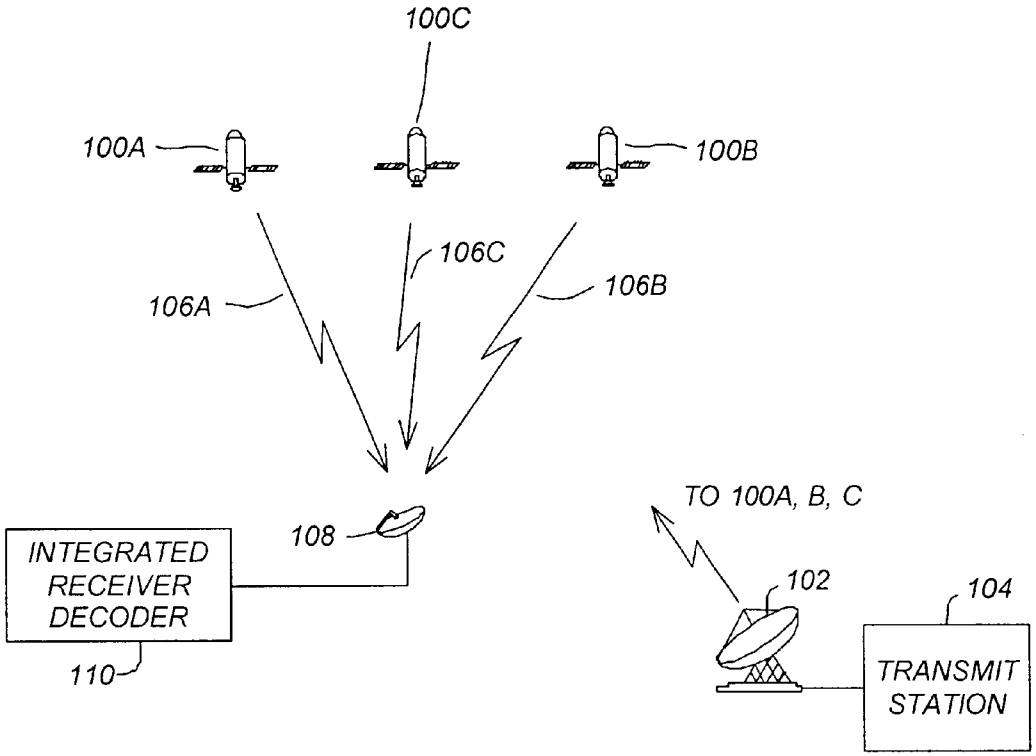
FIG. 1 is a diagram illustrating an overview of a multiple satellite video distribution system according to the preferred embodiment of the present invention.

FIG. 1 is a diagram illustrating an overview of a multiple satellite video distribution system according to the preferred embodiment of the present invention. The system includes multiple satellites 100A–C, uplink antenna 102, and transmit station 104. In the preferred embodiment, the three satellites 100A–C are in three different orbital slots located at 101 West Longitude (WL) 100A, 119 WL 100B, and 110 WL 100C, wherein the video programming signals 106A–C are transmitted from transponders 1–32 on 101 WL 100A, transponders 22–32 on 119 WL 100B, and transponders 28, 30, and 32 on 110 WL 100C. The radio frequency (RF) signals 106A–C are received at one or more downlink antennae 108, which in the preferred embodiment comprise subscriber receiving station antennae 108, also known as outdoor units (ODUs). Each downlink antennae 108 is coupled to one or more integrated receiver-decoders (IRDs) 110 for the reception and decoding of video programming signals 106A–C.

Figure 2:
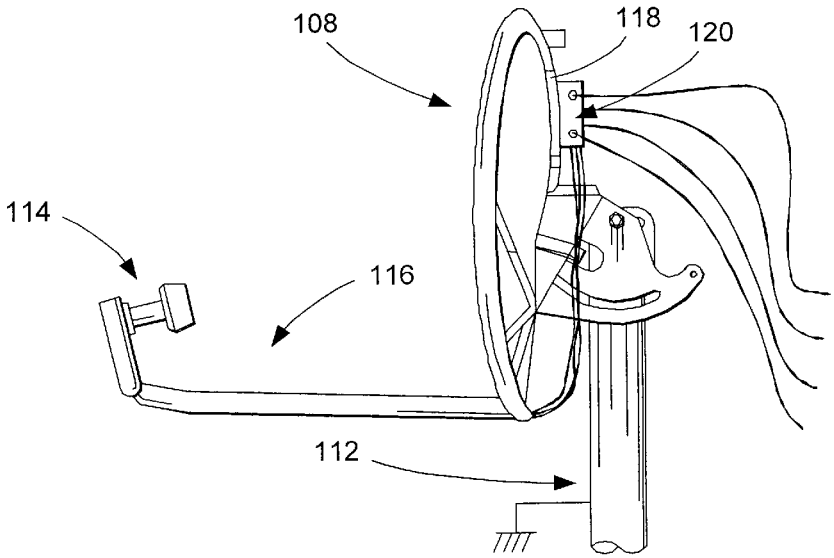
FIG. 2 Prior Art
FIGS. 2 and 3 illustrate the subscriber antenna as configured in the prior art.

FIG. 2 illustrates the subscriber antenna 108 as configured in the prior art. In the side view of FIG. 2, the antenna 108 has an 18"×24" oval-shaped Ku-band reflecting surface that is supported by a mast 112, wherein a minor axis (top to bottom) of the reflecting surface is narrower than its major axis (left to right). The antenna curvature is due to the offset of a low noise block down converter with feed (LNBF) 114, which is used to receive signals reflected from the antenna 108. A support bracket 116 positions one or more of the LNBFs 114 below the front and center of the antenna 108, so that the LNBFs 114 do not block the incoming signals 106A–B. Moreover, the support bracket 116 sets the focal distance between the antenna 108 and the LNBFs 114.

The LNBFs 114 comprise a first stage of electronic amplification for the subscriber receiving station. Each LNBF 114 down converts the 12.2–12.7 GHz downlink signals 106A–B from the satellites 100A–B to a 950–1450 MHz signal required by a tuner/demodulator of the IRD 110. The shape and curvature of the antenna 108 allows the antenna 108 to simultaneously direct energy into two or three proximately disposed LNBFs 114.

In one embodiment, the orbital locations of the satellites 100A–B are chosen so that the signals 106A–C received from each satellite 100A–B can be distinguished by the antenna 108, but close enough so that both signals 106A–B can be received without physically slewing the axis of the antenna 108. When the user selects program material broadcast by the satellites 100A–B, the IRD 110 electrically switches LNBFs 114 to receive the broadcast signals 106A–B from the satellites 100A–B transmitting the broadcast signals 106A–B. This electrical switching occurs using a multi-switch (Multi-SW) 120.

In the side view of FIG. 2, a bracket 118 is used to mount a 4×4 multi-switch 120 at the back of the antenna 108. This configuration comprises the present state of the art, wherein a discrete multi-switch 120 is mounted either at the back of the antenna 108, as shown, or at the point of entry to a home, or inside the home.

Figure 3:
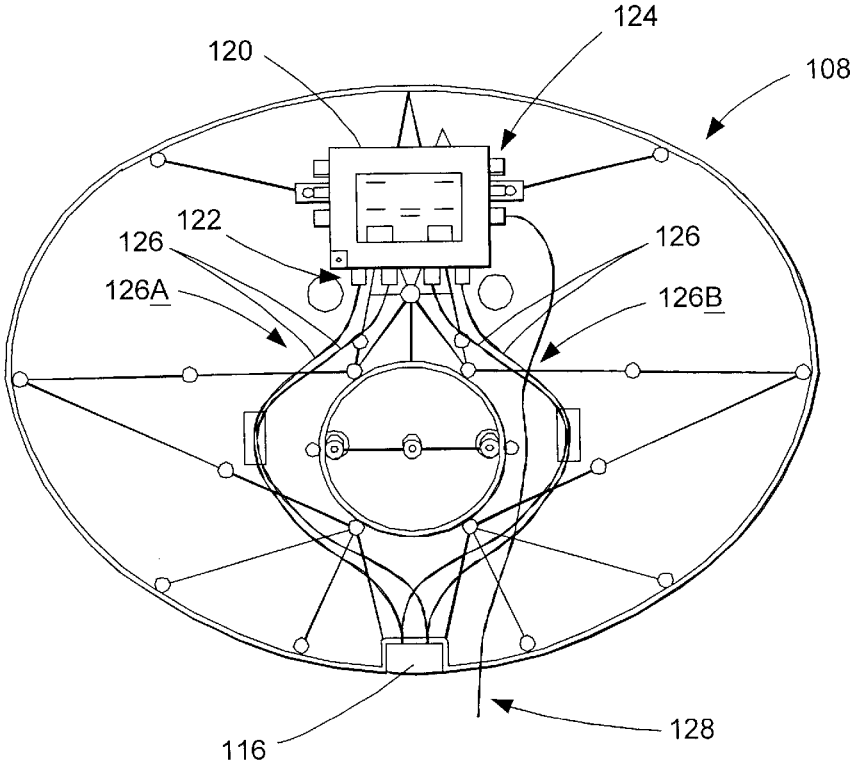
FIG. 3 Prior Art

FIG. 3 shows a back view of the same antenna 108. The 4×4 multi-switch 120 includes four (4) inputs 122 and four (4) outputs 124, each of which is a female 'F' connector. In a multiple-satellite 100A–B application, the IRD 110 must select an output 124 of the multi-switch 120 to connect a given LNBF 114 to the IRD 110. However, this configuration can only support two satellites 100A–B, because it can only accept four inputs (two per LNBF 114).

In this example, there are two coaxial cables 126A from the multi-switch 120 to a dual output LNBF 114 for a first satellite 100A (also known as "Sat A"), and there are two coaxial cables 126B from the multi-switch 120 to a dual output LNBF 114 for a second satellite 100B (also known as "Sat B"). In the preferred embodiment there are also coaxial cables 128 extending from the multi-switch 120 to one or more of the IRDs 110 (in the example of FIG. 3, only a single cable 128 to an IRD 110 is shown connected to the multi-switch 120). Each end of the cables 126, 128 has a male 'F' connector.

Figure 4:
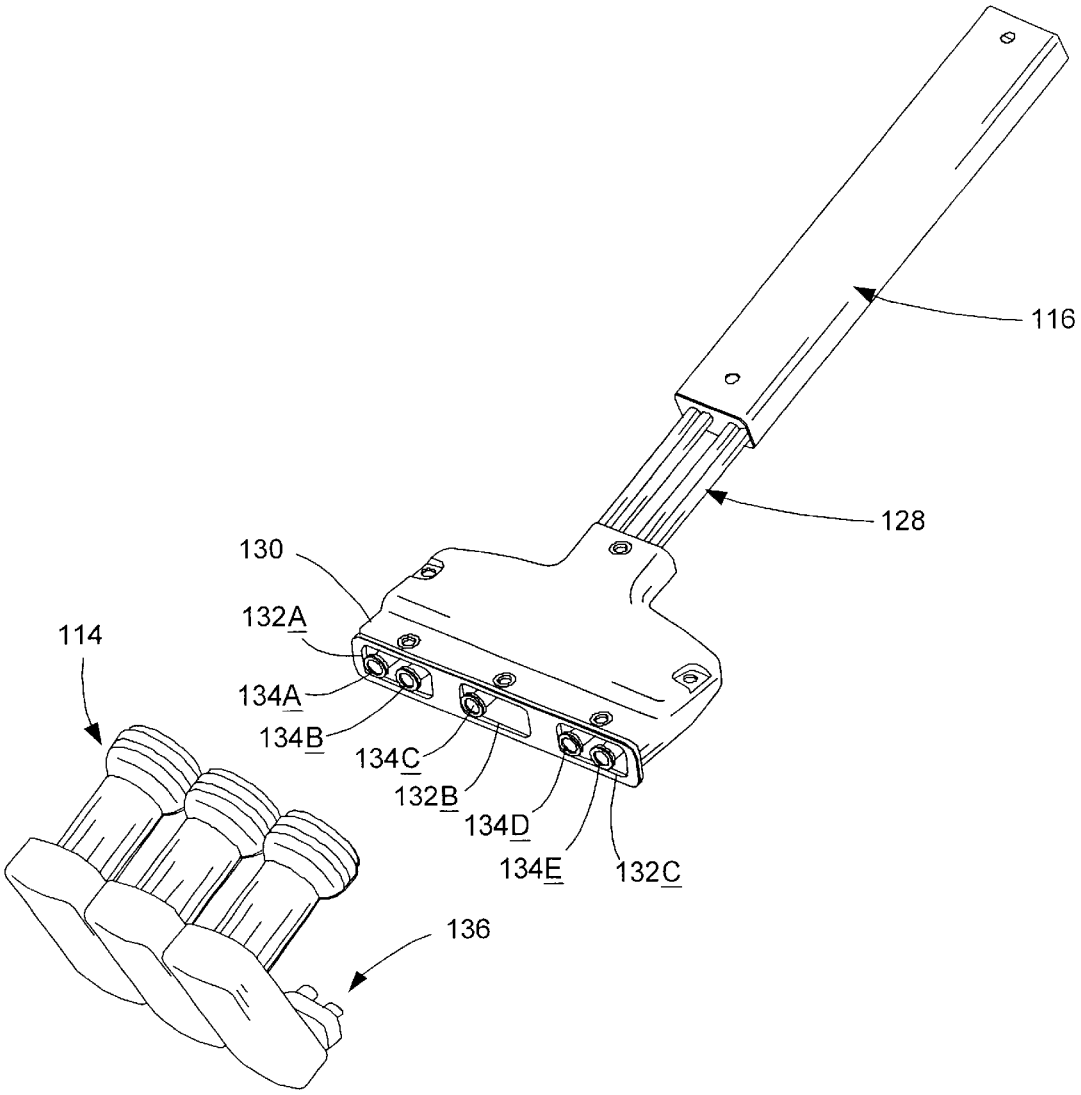
FIG. 4 illustrates the structure of an LNBF/Multi-SW Adapter according to the preferred embodiment of the present invention.

FIG. 4 is an exploded view that illustrates the structure of an LNBF/Multi-SW adapter 130 according to the preferred embodiment of the present invention. In the referred embodiment, the LNBF/Multi-SW Adapter 130 is a single plastic Y-shaped housing that incorporates a combiner and multi-switch (described in FIG. 7), three ports 132A–B for connection to three LNBFs 114, and four outputs that comprise cables 128 that exit from the rear of the Adapter 130 for connection to the IRDs 110.

Two of the three ports 132A and 132C have two male 'F' connectors 134 and one of the three ports 132B has a single male 'F' connector 134. A dual output LNBF 114 is inserted into each of ports 132A and 132C, while a single output LNBF 114 is inserted into port 132B. The female 'F' connectors 136 comprising the output IF terminals of each LNBF 114 simply plug into the male 'F' connectors 134 of the Adapter 130. The male 'F' connectors 134 of the Adapter 130 are recessed in the ports 132A–C for proper mating with the female 'F' connectors 136 of each LNBF 114, and have central conductors and inner rib springs to provide good electrical contact with the female 'F' connectors 136 of each LNBF 114. Of course, those skilled in the art will recognize that other embodiments could have different numbers of ports 132, different configurations of connectors 134, and support various types and numbers of LNBFs 114.

The Adapter 130 mates to the support bracket 116, although the Adapter 130 is shown separated from the support bracket 116 in FIG. 4 for the purposes of illustration. Typically, a screw and nut arrangement is used to attach the Adapter 130 to the support bracket 116. In this embodiment, the support bracket 116 comprises a hollow tube that carries the cables 128 to the rear of the antenna 108 for connection to the IRDs 110.

Figure 5:
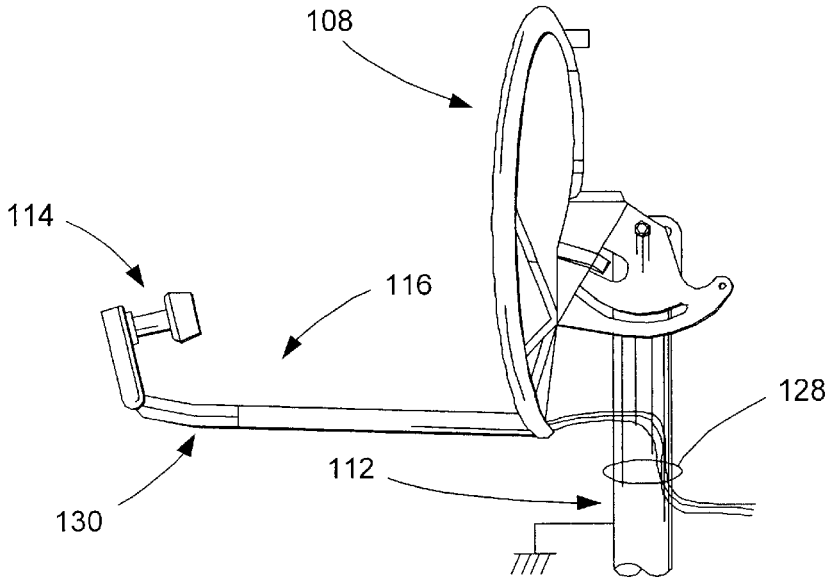
FIGS. 5 and 6 illustrate the antenna configured according to the preferred embodiment of the present invention.
Figure 6:
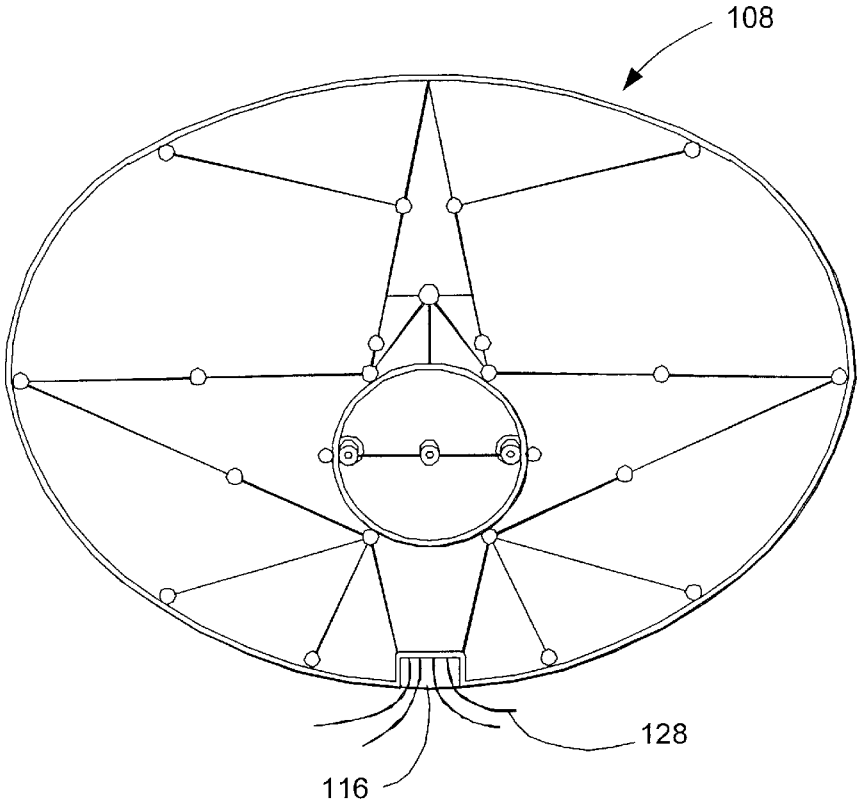

FIGS. 5 and 6 illustrate the antenna 108 configured according to the preferred embodiment of the present invention. In the side view of FIG. 5, as in FIG. 2, the antenna 108 is an 18"×24" oval-shaped Ku-band reflecting surface that is supported by an antenna mast 112. However, FIG. 5 differs from FIG. 2 in that the multi-switch 120 is built into an LNBF/Multi-SW Adapter 130, rather than being mounted at the rear of the antenna 108. The LNBFs 114 are plugged into the LNBF/Multi-SW Adapter 134 and the LNBF/Multi-SW Adapter 134 itself is mated to the support bracket 116. The support bracket 116 automatically positions the Adapter 130 and LNBFs 114 below the front and center of the antenna 108. Only the coaxial cables 128 that connect to the IRD 110 exit from the support bracket 116 at the rear of the antenna 108.

FIG. 6 shows the back view of the same antenna 108, where it can be seen that the 4×4 multi-switch 120 is no longer mount at the rear of the antenna 108, as was shown in FIG. 3. The only cables shown are the coaxial cables 128 exiting from the support bracket 116 for connection to the IRD 110.

Figure 7:
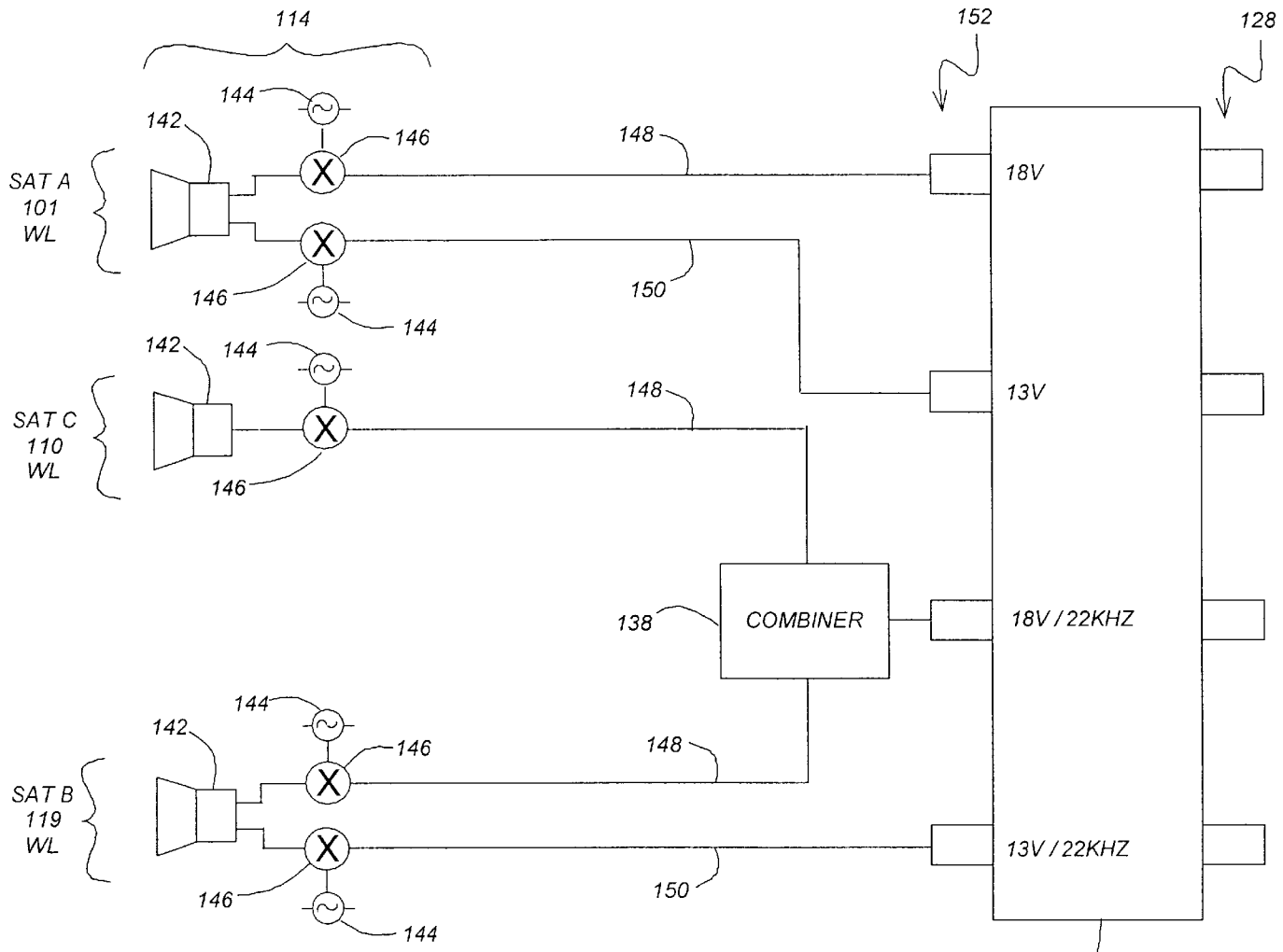
FIG. 7 illustrates the operation of a multi-switch and combiner according to the preferred embodiment of the present invention.

FIG. 7 illustrates the operation of a combiner 138 and multi-switch 140 arrangement according to the preferred embodiment of the present invention. The combiner 138 and multi-switch 140 arrangement is described in detail in co-pending and commonly-assigned application Ser. No. 09/675,526, filed on same date herewith, by Dipak M. Shah, and entitled "AGGREGATED DISTRIBUTION OF MULTIPLE SATELLITE TRANSPONDER SIGNALS FROM A SATELLITE DISH ANTENNA," which application is incorporated by reference herein. In the preferred embodiment, the combiner 138 and multi-switch 140 are housed within the Adapter 130, although other embodiments could mount these components in any location.

The 12.2–12.7 GHz signals 106A–C received from the satellites 100A–C pass through a feed horn 142 of the LNBF 114 and are down converted by a local oscillator 144 and multiplier 146 in the LNBF 114 to the 950–1450 MHz signals required by a tuner/demodulator of the IRDs 110. Left and right polarized signals 148 and 150 are output from the LNBFs 114.

The local oscillator 144 and multiplier 146 in the LNBF 114 for 110 WL 100C are used to relocate the channels for 110 WL 100C for the purposes of the present invention. Specifically, the local oscillator 144 and multiplier 146 in the LNBF 114 for 110 WL 100C relocates the three channels received from 110 WL 100C into unused positions within the assigned 950–1450 MHz spectrum of 119 WL 100B (in one example, channels 28, 30, and 32 are relocated to channels 8, 10, and 12). The combiner 138 masks the unused 119 WL 100B channels and combines the relocated 110 WL 100C channels with the assigned 950–1450 MHz spectrum of 119 WL 100B. Specifically, the combiner 138 sums the relocated channels from 110 WL 100C with the channels received from 119 WL 100B (in one example, relocated channels 8, 10, and 12 from 110 WL 100C are summed with channels 22–32 from 119 WL 100B) within the assigned 950–1450 MHz spectrum.

Those skilled in the art will note that the channel assignments provided above are merely illustrative, and that any desired channel arrangement could be used by proper selection of the local oscillator 144 frequency. Moreover, those skilled in the art will recognize that channels from more than two signal polarizations could be relocated and aggregated using the present invention, with the use of additional or different combiners 138, oscillators 144, and multipliers 146.

This summed output from the combiner 138 is then provided to a single input 152 of the multi-switch 140. The multi-switch 140 generally comprises a cross-bar switch, wherein any of the four cables 128 can be connected to any of the four inputs 152. The selection of which input 152 to connect to a desired cable 128 via the multi-switch 140 is controlled by a signal received on the coaxial cable 128 from the IRD 110, in a manner well known in the art (e.g., an 18V, 13V, 18V/22 kHz, or 13V/22 kHz signal from the IRD 110 selects one of the four inputs 152 to the multi-switch 140).

Thus, the combiner 138 aggregates the signals 106B and 106C received from satellites 100B and 100C before the multi-switch 140 in order to decrease the number of inputs 152 needed on the multi-switch 140. Consequently, a four-input multi-switch 140 can be used to select among five different signals output from three different LNBFs 114 based on three different sets of signals 106A–C received from transponders on three different satellites 100A–C. Moreover, fewer sets of cables 128 are required and the polarization switching requirements for the LNBFs 114, multi-switch 140, and IRDs 110 are simplified, thereby resulting in significant savings in component and installation costs.

This concludes the description of the preferred embodiments of the present invention. The foregoing description of the preferred embodiment of the invention has been presented for the purposes of illustration and description. It is not intended to be exhaustive or to limit the invention to the precise form disclosed. Many modifications and variations are possible in light of the above teaching.

It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A low noise block down converter adapter for an antenna, comprising a housing, incorporating within said housing; a plurality of ports for connecting to a plurality of low noise block down converters with feed (LNBFs), a plurality of outputs, and within said same housing a multi-switch for connecting a selected one of the LNBFs to a selected one of the outputs.

2. The adapter of claim 1, wherein the adapter includes three of the ports for connecting to three of the LNBFs, two of the ports each having two connectors for connecting to dual output LNBFs, and one of the ports having a single connector for connecting to a single output LNBF.

3. The adapter of claim 2, wherein the connectors comprise male 'F' connectors.

4. The adapter of claim 3, wherein the male 'F' connectors are recessed in the ports of the adapter.

5. The adapter of claim 3, wherein the male 'F' connectors mate with female 'F' connectors of the LNBFs.

6. The adapter of claim 1, wherein the outputs each comprise a coaxial cable for connection to an integrated receiver-decoder (IRD).

7. A low noise block down converter adapter for an antenna, comprising a housing incorporating a plurality of ports for connecting to a plurality of low noise block down converters with feed (LNBFs), a plurality of outputs, and a multi-switch for connecting a selected one of the LNBFs to a selected one of the outputs, wherein the housing is a Y-shaped housing that is mated to a support backet for the LNBFs.

8. A low noise block down converter adapter for an antenna, comprising a housing incorporating a plurality of ports for connecting to a plurality of low noise block down converters with feed (LNBFs), a plurality of outputs, and a multi-switch for connecting a selected one of the LNBFs to a selected one of the outputs, wherein the housing is a Y-shaped housing that is mated to a support backet for the LNBFs, wherein the support bracket comprises a hollow tube that carries cables from the multi-switch to the rear of the antenna for connection to one or more integrated receiver-decoders (IRDs).

9. An antenna for receiving radio frequency (RF) signals transmitted from a communications satellite, for converting the received RF signals into electric signals, for amplifying the electrical signals, and for outputting the amplified signals to a receiver, comprising:

a reflecting surface positioned on a mast;

a plurality of low noise block down converters with feed (LNBFs), wherein each of the LNBFs converts the RF signals into the electric signals and amplifies the electric signals; and an LNBF adapter connected to the LNBFs and mated to a support bracket coupled to the mast, wherein the mated LNBF adapter and support bracket position the LNBFs in front of the reflecting surface to receive the RF signals transmitted by the satellite and reflected from the reflecting surface, the LNBF adapter comprising a housing, within said housing integrally incorporating both; a plurality of ports for connecting to a plurality of the LNBFs, a plurality of outputs, and a multi-switch for connecting a selected one of the LNBFs to a selected one of the outputs.

10. The antenna of claim 9, wherein the support bracket comprises a hollow tube that carries cables from the multi-switch to the rear of the antenna for connection to one or more integrated receiver-decoders (IRDs).

11. The antenna of claim 9, wherein the adapter includes three of the ports for connecting to three of the LNBFs, two of the ports each having two connectors for connecting to dual output LNBFs, and one of the ports having a single connector for connecting to a single output LNBF.

12. The antenna of claim 11, wherein the connectors comprise male 'F' connectors.

13. The antenna of claim 12, wherein the male 'F' connectors are recessed in the ports of the adapter.

14. The antenna of claim 12, wherein the male 'F' connectors mate with female 'F' connectors of the LNBFs.

15. The antenna of claim 9, wherein the outputs each comprise a coaxial cable for connection to an integrated receiver-decoder (IRD).

16. An antenna for receiving radio frequency (RF) signals transmitted from a communications satellite, for converting the received RF signals into electric signals, for amplifying the electrical signals, and for outputting the amplified signals to a receiver, comprising:

a reflecting surface positioned on a mast;

a plurality of low noise block down converters with feed (LNBFs), wherein each of the LNBFs converts the RF signals into the electric signals and amplifies the electric signals; and an LNBF adapter connected to the LNBFs and mated to a support bracket coupled to the mast, wherein the mated LNBF adapter and support bracket position the LNBFs in front of the reflecting surface to receive the RF signals transmitted by the satellite and reflected from the reflecting surface, the LNBF adapter comprising a housing incorporating a plurality of ports for connecting to a plurality of the LNBFs, a plurality of outputs, and a multi-switch for connecting a selected one of the LNBFs to a selected one of the outputs, wherein the housing is a Y-shaped housing.

17. Amplification and switching electronics for radio frequency (RF) signals transmitted from a communications satellite and received at an antenna, comprising:

a plurality of low noise block down converters with feed (LNBFs) for converting the RF signals received by the antenna into electric signals and for amplifying the electric signals for output to a receiver; and an LNBF adapter said LNBF adapter integrally having within said adapter a plurality of ports for connecting to the LNBFs, a plurality of outputs for connecting to a plurality of integrated receiver-decoders (IRDs), and also integrally incorporating a multi-switch for connecting a selected one of the LNBFs to a selected one of the outputs.

* * * * *